United States Patent [19]

Moriyama et al.

[11] 3,972,608

[45] Aug. 3, 1976

[54] COLOR COPYING APPARATUS HAVING ONE OR MORE SCREEN-LIKE PHOTOSENSITIVE MEMBERS

[75] Inventors: Inao Moriyama, Ebina; Keiji Tanaka, Kawasaki; Yujiro Ando, Yokohama; Katsunobu Ohara, Kawasaki, all of Japan

[73] Assignee: Canon Kabushiki Kaisha, Tokyo, Japan

[22] Filed: July 30, 1974

[21] Appl. No.: 493,653

[30] Foreign Application Priority Data

Aug. 1, 1973 Japan ..... 48-87074
Aug. 1, 1973 Japan ..... 48-87075

[52] U.S. Cl. ..... 355/4; 355/3 R; 355/16

[51] Int. Cl.[2] ..... G03G 15/01

[58] Field of Search ..... 355/4, 16, 3 SC; 96/1.2

[56] References Cited

UNITED STATES PATENTS

| | | | |
|---|---|---|---|
| 3,531,195 | 9/1970 | Tanaka et al. | 96/1.2 |
| 3,582,206 | 6/1971 | Burdige | 355/16 |
| 3,645,614 | 2/1972 | McFarlane et al. | 355/3 R |
| 3,666,364 | 5/1972 | Marushima | 355/3 R |
| 3,811,765 | 5/1974 | Blake | 355/3 R |

*Primary Examiner*—L. T. Hix
*Assistant Examiner*—Kenneth C. Hutchison
*Attorney, Agent, or Firm*—Fitzpatrick, Cella, Harper & Scinto

[57] ABSTRACT

In a color copying apparatus using a movable photosensitive medium having a plurality of openings therein, there are provided exposure means for exposing the photosensitive medium to color images corresponding to an original image, primary electrostatic image forming means for forming on the photosensitive medium an electrostatic latent image corresponding to the original image, support means for movably supporting a charge-retaining member in non-contact relationship with the photosensitive medium, secondary electrostatic image forming means for forming on the charge-retaining member an electrostatic image corresponding to the electrostatic latent image on the photosensitive medium, and developing means having a plurality of developing units disposed adjacent the support means to impart predetermined color developers.

4 Claims, 13 Drawing Figures

| FIG. 4A | FIG. 4B |
|---|---|

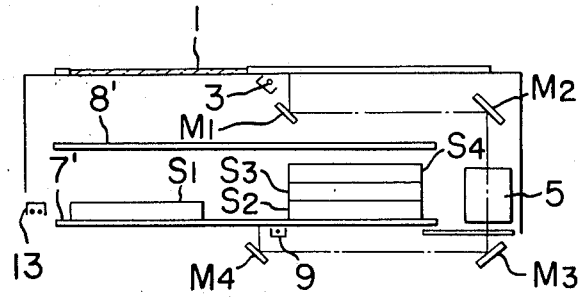
FIG. 6a
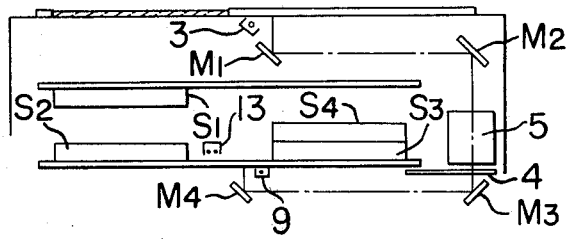
FIG. 6b
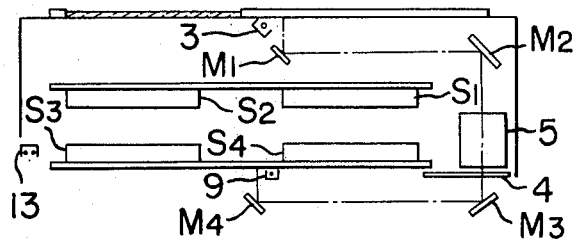
FIG. 6c
FIG. 8a
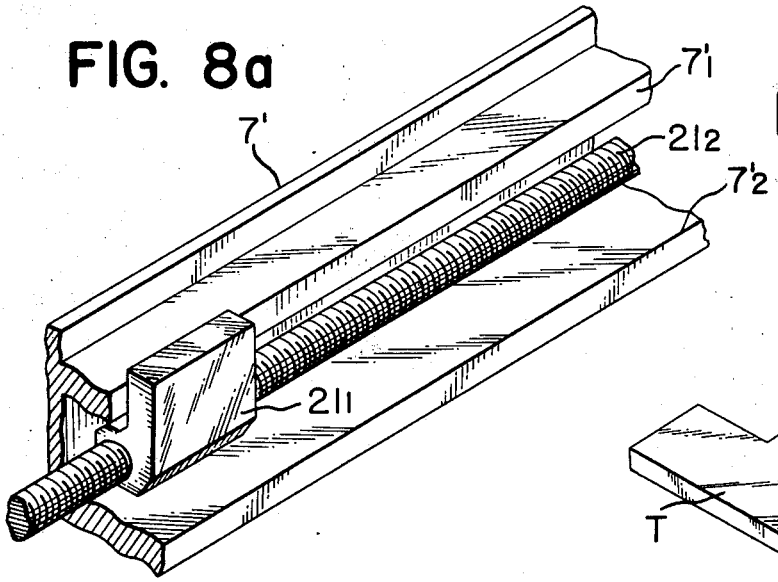
FIG. 8b
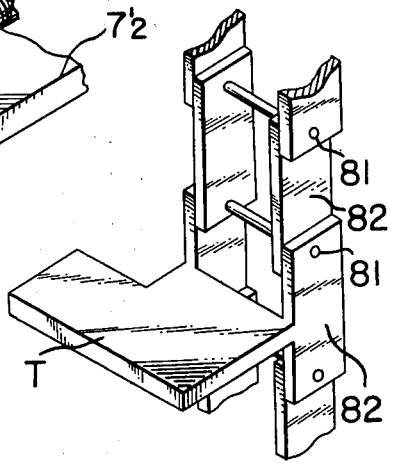

COLOR COPYING APPARATUS HAVING ONE OR MORE SCREEN-LIKE PHOTOSENSITIVE MEMBERS

BACKGROUND OF THE INVENTION

1. Field of the Invention

This invention relates to a color copying apparatus, and more particularly to a color copying apparatus which uses one or more photosensitive mediums (screen-like photosensitive mediums) each have a plurality of small-diameter openings to enable good color representation to be accomplished.

2. Description of the Prior Art

Color copying apparatuses have generally given rise to various problems which would not be experienced in monochrome copying apparatuses for producing black-and-white copies. These problems include the problem of alignment for color resolution and exposure to a multi-color image, the problem of color mixture resulting from the use of multiple color developers, and the problem of offset which is a phenomenon that a color developer once transferred from a photosensitive medium to a recording medium is re-transferred to the photosensitive medium.

Various types of electrophotographic color copying apparatus have heretofore been proposed, but in the type of apparatus based on the Carlson process, for example, color mixture has readily occurred because various color developers are used on a photosensitive medium.

Also, in the apparatuses based on TESI process wherein transfer of latent image is effected, the possibility of developer being re-transferred to the photosensitive medium occurs during representation of a second or subsequent color, with a result that the final copy image might be degenerated in quality as has been experienced in the above-described apparatuses based on the Carlson process.

In these apparatuses wherein a transfer medium is brought into direct contact with a photosensitive medium, the transfer medium is apt to be misaligned with respect to the photosensitive medium and this may lead to the probability that resultant copies may misregister.

U.S. Pat. No. 3,532,422, issued to S.B. McFarlane Oct. 6, 1970, discloses an apparatus in which a color image may be formed without the copy medium being brought into direct contact with a photosensitive medium. According to this patent, a photosensitive medium comprising a mesh-like metal grid covered with a photoconductive member is electrostatically charged and exposed to image light, whereafter a formed electrostatic latent image is developed by means of a predetermined color developer, and then the developer image is transferred to transfer paper disposed with an air space with respect to the photosensitive medium.

Such apparatus is not subject to the possibility of the transfer paper being misaligned and does not require any complicated mechanism for ensuring the registration, but due to the grid-like configuration of the photosensitive medium, difficulties might be encountered in satisfactorily removing the once used developer from the photosensitive medium, thus resulting in color mixture in the final copy.

SUMMARY OF THE INVENTION

It is an object of the present invention to provide a color copying apparatus which can perform good color representation.

It is another object of the present invention to provide a color copying apparatus which eliminates any factor which could cause color mixture, and permits good color representation to be achieved.

It is still another object of the present invention to provide a color copying apparatus which can attain a good color balance.

It is yet another object of the present invention to provide a color copying apparatus which is compact and highly stable.

Generally, the present invention involves the steps of exposing a movable photosensitive medium having a plurality of openings therein to an image light having a color component of an original image to thereby form an electrostatic latent image on the photosensitive medium, forming a charge image corresponding to the electrostatic latent image on a charge retaining recording medium, supported by support means, with the aid of secondary electrostatic image forming means, and developing such charge image into a visible image by means of a predetermined color developer. These steps are repeated in accordance with a predetermined number of colors to be represented, thereby producing a colored copy.

The term "screen-like photosensitive medium" or "screen" used herein refers to a photosensitive medium having a plurality of openings therein so that the charge passing through these openings is controllable in accordance with the electrostatic latent image formed on the photosensitive medium. The configuration of the photosensitive medium is not restricted to the specific forms shown herein but any other configuration which will match the present invention may be suitably selected.

Also, the term "recording medium" used herein is one having a good charge-retaining characteristic.

The invention will become more fully apparent from the following detailed description thereof taken in conjunction with the accompanying drawings.

BRIEF DESCRIPTION OF THE DRAWINGS

FIGS. 6*a* –6*c* illustrate the movement of the photosensitive mediums in the embodiment of FIG. 5.

FIGS. 8*a* and 8*b* are enlarged details of FIG. 7.

DESCRIPTION OF THE PREFERRED EMBODIMENTS

Figure 1:
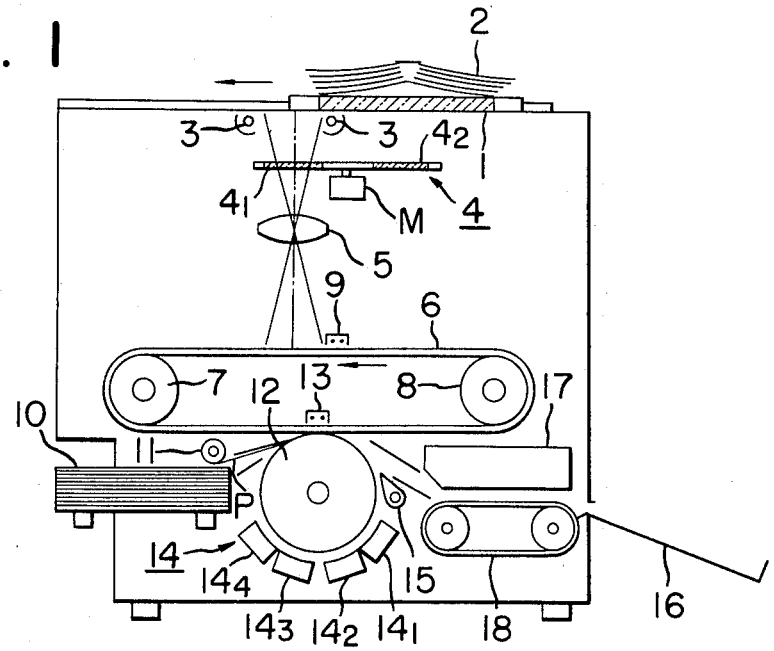
FIG. 1 schematically illustrates an embodiment of the apparatus according to the present invention.

In the apparatus shown in FIG. 1, an original 2 on an original carrier 1 is illuminated by an illuminating light source 3. The image of the original so illuminated is passed through a desired color filter $4_1$ (which may be red, for example) provided in color resolving means 4, and directed through an optical system 5 to an exposure position for photosensitive medium 6. The photosensitive medium 6 is a mesh-like screen having a photoconductive layer, and is disposed in an endless form between a drive roller 7 and a guide roller 8.

The photosensitive medium 6 is charged by a charger 9 prior to or simultaneously with the exposure, to thereby form a electrostatic latent image thereon. It will be apparent that the photosensitive medium and the latent image forming means may take any suitable form in accordance with the electrostatic latent image forming process adopted. For example, the electrophotographic method already proposed by the applicant, i.e. the electrostatic latent image formation using a screen-like photosensitive medium with the so-called NP process, will be highly effective, because the electrostatic latent image so formed is of very high contrast and good control of ion flow is ensured during the secondary electrostatic image formation to provide a high resolving power. Moreover, such process is highly effective in that it ensures a high degree of retention of the primary electrostatic image when the secondary electrostatic image formation is effected, i.e. when the so-called retention copying is effected.

Figure 2:
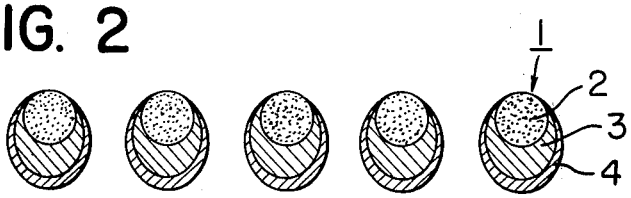
FIG. 2 illustrates the construction of a screen-like photosensitive medium applicable to the present invention.

The screen-like photosensitive medium 1 used for such process comprises, as shown in FIG. 2, a conductive substrate 2 having a number of minute openings, and a photoconductive member 3 and an insulating member 4 provided in successive layers on the conductive substrate. The conductive substrate may be formed either by etching a plate-like member of stainless steel, nickel or like metal to form minute openings therein or by knitting a wire of said metal into a mesh-like form. The photoconductive member may most suitably be provided either by evaporating Se-alloy or the like or by spraying CdS, PbO or like material dispersed in resin. The insulating member may be provided by spraying or vacuum-evaporating a solvent type, inorganic insulating material such as epoxy resin, acrylic resin, silicon resin or the like.

Negative or positive charge is imparted to the insulating layer of the screen-like photosensitive medium of the above-described construction, in accordance with the polarity i.e. P- or N- type, of the photoconductive member, whereafter charge of the opposite polarity or AC corona discharge is imparted simultaneously with or before or after the image exposure, and then uniform overall exposure is effected, whereby there is formed an electrostatic latent image of high contrast. Such processing means may be disposed as the primary electrostatic image forming means of the above-described apparatus, as already mentioned.

On the other hand, a sheet of recording medium P is fed from a supply cassette 10 to a recording medium holding roller 12 by means of a feed roller 11 or the like. The recording medium P is held against the roller 12 either mechanically by a restraining pawl or electrostatically (not shown). At a secondary electrostatic image forming station, corona ions from corona discharger 13 form an electrostatic image on the recording medium P in accordance with the electrostatic latent image on the photosensitive medium 6. Thereafter, the electrostatic image on the recording medium P is developed by a desired color (for example, cyan) developing unit $14_1$ in developing means 14. In the color representation wherein three or four colors are superposed one upon another to provide a copy image true to the original image, the above-described process is repeated for each of the colors, thereby providing a true colored image on the recording medium P. Thereafter, the recording medium P having the secondary electrostatic image formed thereon is separated form the holding roller 12 by separator means such as separator pawl 15 or the like, and discharged onto a tray 16. By making the length of the photosensitive medium 6 equal to or greater than the sum of the lengths of the images corresponding to the number of colors to be represented, i.e. three or four colors images, and by once forming each resolved color image on the photosensitive medium, any desired number of colored copies may be produced without exposure required thereafter.

In the present case, after image exposure for color resolution has taken place three or four times, only the corona discharger 13 and the developing means 14 cooperate with recording medium supply means 10 and the separator means to provide a plurality of copies.

Figure 3:
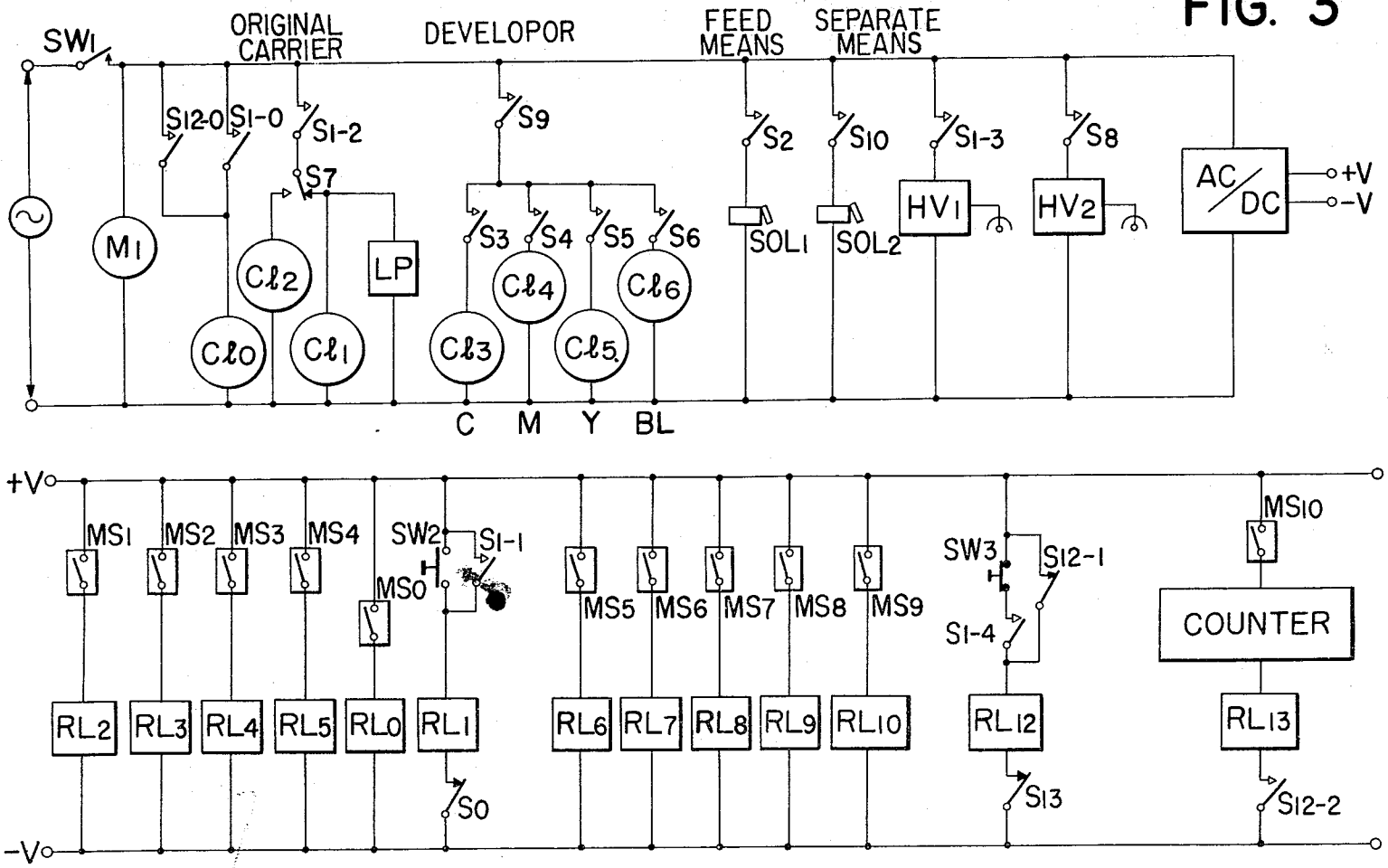
FIG. 3 is a diagram showing a form of the control circuit.
Figure 4A:
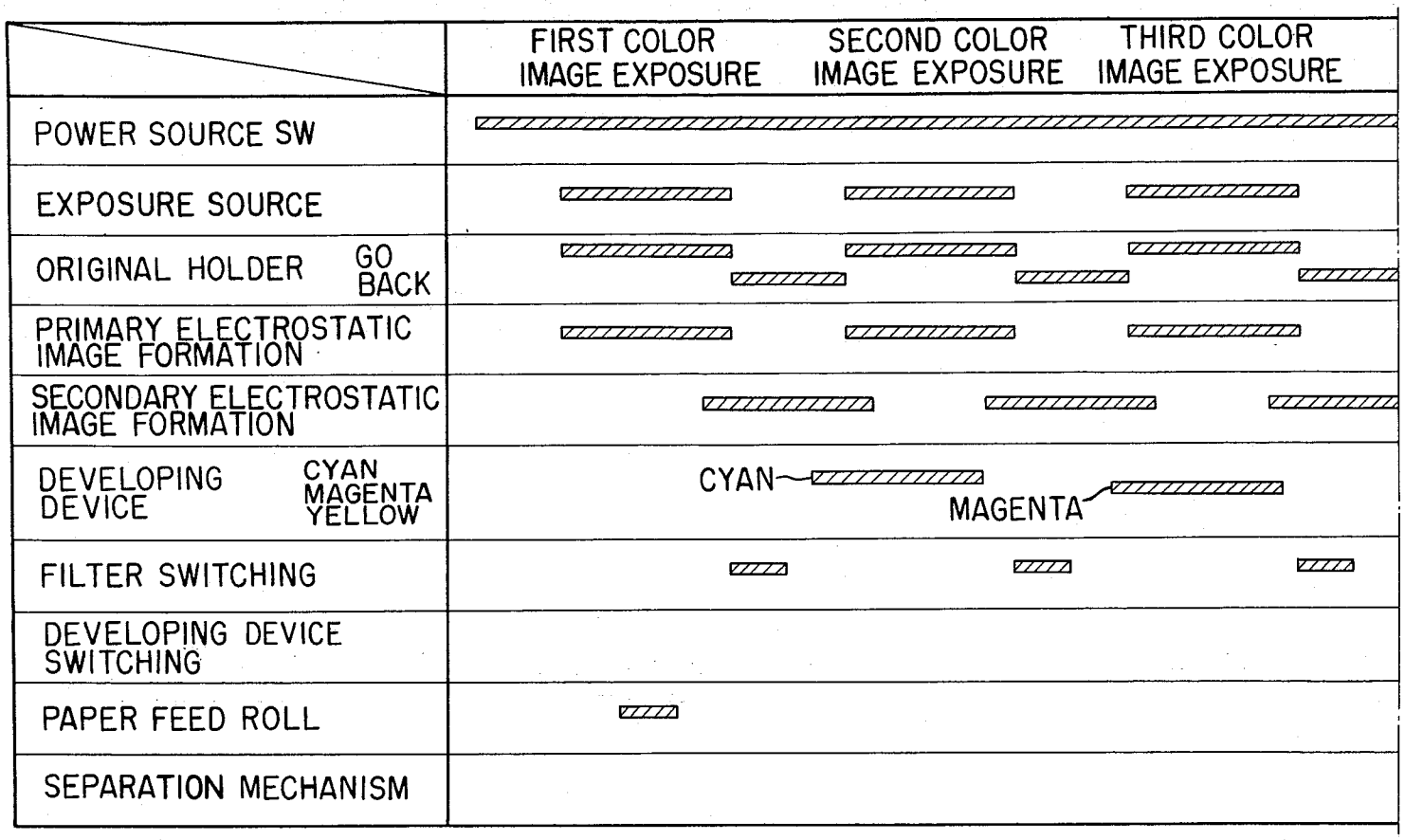
FIGS. 4, 4a, and 4b depict a chart illustrating the control sequence of the control circuit.
Figures 4, 4B:
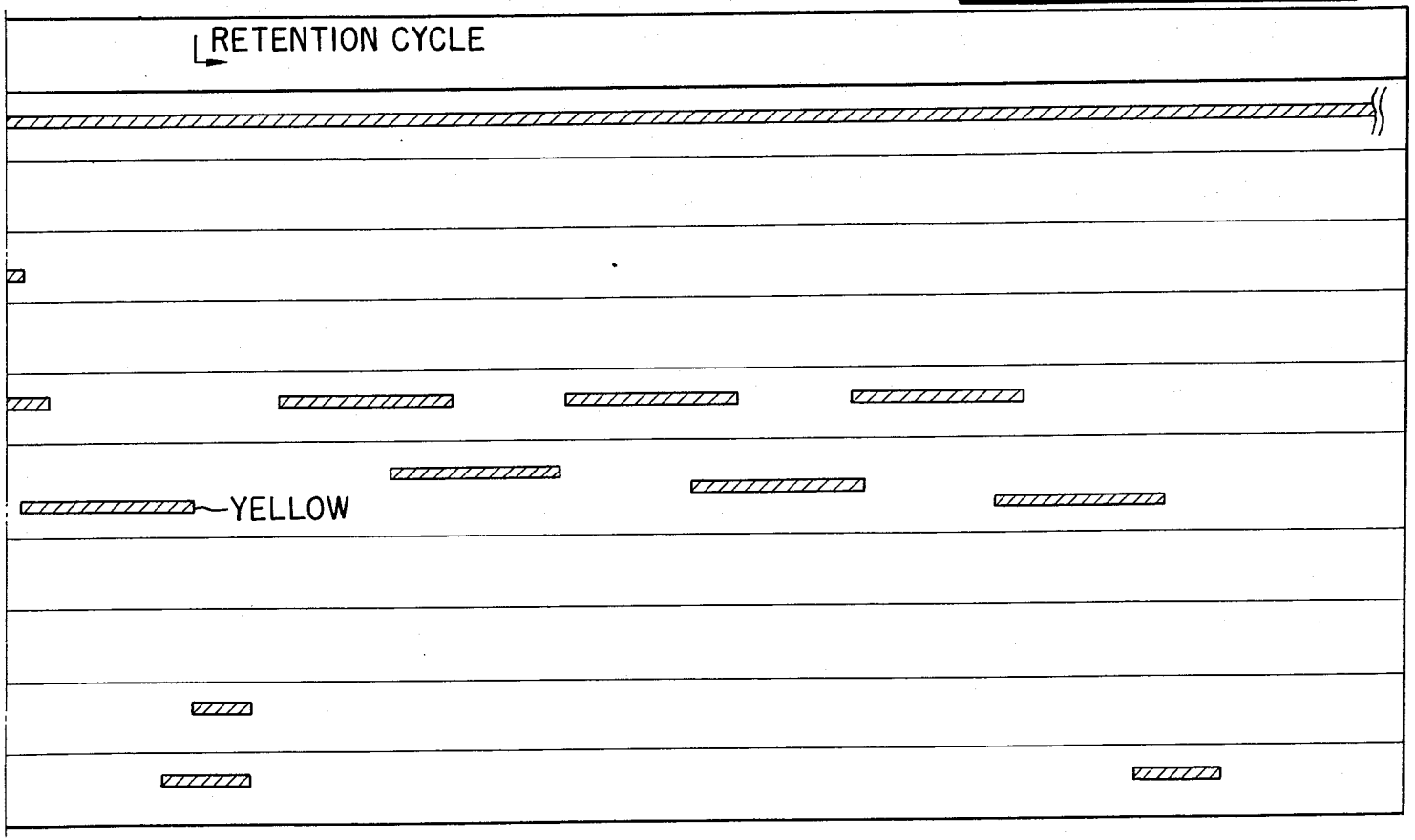

FIG. 3 shows an example of the described embodiment, and FIG. 4 is a chart illustrating an example of the control time sequence.

Closing of a main switch SW1 energizes a main motor M1 which is the drive source for all moving parts. Closing of a copy switch SW2 energizes a relay RL1 to close switches S1-0, S1-1, S1-2, and S1-3. The switch S1-0 operates an electromagnetic clutch $C1_0$, which actuates a control cam plate, not shown. The cam plate in turn actuates a group of subsequent microswitches in accordance with the time sequence, as shown in FIG. 4, for example. By the closing of switch S1-1, relay RL1 selfholds its energized condition until a normally closed switch $S_0$ is opened. Upon closing of switch S1-2, an electromagnetic clutch $C1_1$ connected to the normally closed contact of switch S7 an an exposure lamp LP are energized. The energization of the electromagnetic clutch $C1_1$ initiates the forward movement of the original carrier. Upon termination of its forward movement, the original carrier operates a microswitch MS6 which energizes a relay RL7 to change over and reset a switch S7. Closing of switch S1-3 initiates operation of a high voltage source HV1 for the formation of primary electrostatic image. As the cam plate is moved, microswitch MS1 is closed to energize a relay RL2 and close a switch S2 of solenoid SOL1 which sets the feed roller to its feeding position. A recording medium is fed by the feed roller or the like, and at a stage ready for forming a secondary electrostatic image, microswitch MS7 is closed to energize relay RL8. Thereby, switch S8 of a high voltage source S2 for the formation of secondary electrostatic image is closed. On the other hand, microswitch MS2, MS3, MS4 or MS5 is selectively closed in accordance with a color to be represented, and a predetermined one of switches S3, S4, S5 and S6 is closed so as to operate any desired one of the developing units in the developing means. The developing operation occurs with relay RL9 energized upon closing of microswitch MS8 and with switch S9 maintained in closed position.

By selective switching (unshown) of the control circuit in accordance with monochromatic or multi-color representation, image formation is effected on the recording medium, whereafter microswitch MS9 is closed to energize relay RL10. Thereby, switch 10 is closed to energize solenoid SOL2 which drives the separator means such as separator pawl or the like.

When a monochromatic or multi-color copy has been produced, microswitch MSO is operated to energize relay RLO. Thereby, switch SO is opened to deenergize relay RL1 which has so far been self-holding.

Where a number of monochromatic or multi-color copies are to be produced for the same original, retention copy button SW3 is preset. By this means the electromagnetic clutch $C1_0$ for driving the control cam plate is maintained energized even after the deenergization of relay RL1. Of course, in such case, the exposure of the original carrier and the primary electrostatic image forming means need not be operated at all. Upon closing of microswitch MS10 or the like, the number of copies desired is entered into a counter COU for storing such number and, when the desired number of copies is reached, relay RL13 is energized to deenergize relay RL12 which has so far been self-holding.

The apparatus of the above-described embodiment is very suitable for high-speed representation in that it uses an endless photosensitive medium. However, if it is attempted to improve the color balance by using a photosensitive medium having a different wavelength sensitivity characteristic for each color to be represented, the endless photosensitive medium must be tensioned and moved round and this would lead to an increased size of the apparatus. Also, continuous rotation of the photosensitive medium would cause deterioration of the same and thus, maintenance and check-up of the photosensitive medium would be required. Thus, the apparatus of the above-described construction is most suitable as a color copying apparatus for business use, whereas it is somewhat inconvenient as a business instrument to be installed in offices, because it is large-sized and requires strict maintenance and check-up. A more compact apparatus according to another embodiment of the present invention will now be described.

Figure 5:
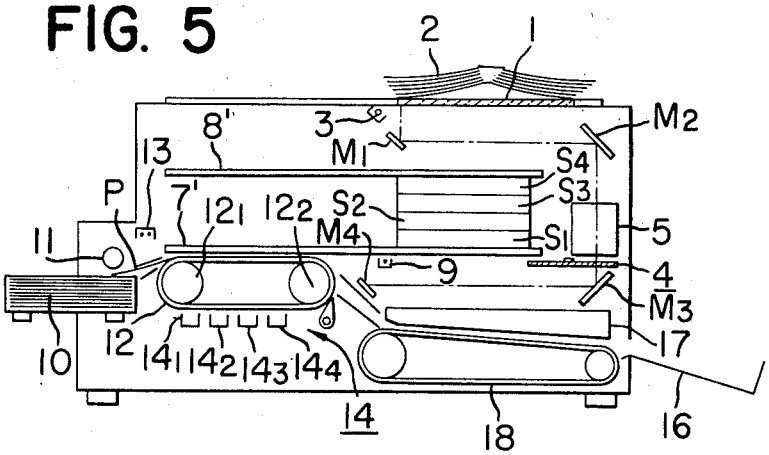
FIG. 5 schematically illustrates another embodiment of the apparatus according to the present invention.

FIG. 5 shows the apparatus according to a different embodiment of the present invention wherein an original 2 resting on an original carrier 1 is illuminated by an illuminating light source 3. The image of the original 2 so illuminated is passed through color resolving means 4 and focused at an exposure position through an optical system including a lens system 5 and mirrors M1, M2, M3, and M4. A plurality of photoconductive screens S1, S2, S3 and S4 are disposed in successive flat layers and designed such that they are cyclically moved through primary and secondary electrostatic image forming positions and back to their initial positions. If these screenlike photosensitive mediums have different sensitivity characteristics, better color representation can be provided. In such construction, the first screen S1 is pre-charged by a charger 9 prior to exposure. At the primary electrostatic image forming position, the first screen S1 is exposed to a resolved color image of the original (for example, the image passed through red filter), thereby forming a latent image thereon.

On the other hand, a recording medium P such as insulative copy paper or the like is fed from a supply cassette 10 to a recording medium conveying and holding belt 12 by means of a feed roller 11 and electrostatically or otherwise held against the belt.

FIGS. 6*a* to 6*c* illustrate the movement of the screens. From the position shown in FIG. 5, the first screen S1 is moved for exposure and to the secondary electrostatic image forming position, as shown in FIG. 6*a*. By that time, the second screen S2 has already been moved to a position in which it is ready to be conveyed to the exposure position. A corona discharger 13 moves the first screen S1 to form on the recording medium P an electrostatic image corresponding to the latent image on the screen S1. The electrostatic image formed on the recording medium P is moved with movement of the conveyor belt 12 and developed into a visible image at a developing station 14, whereafter the recording medium is again moved to the secondary electrostatic image forming position. Thereupon, a developing unit $14_1$ is driven which imparts a developing color corresponding to the resolved color of the electrostatic image (for example, cyan corresponding to the red filter). On the other hand, after the latent image on the screen S1 has been used to form the secondary electrostatic image, the second screen S2 is moved to the secondary electrostatic image forming position (see FIG. 6*b*). On the screen S2, there is already formed a latent image by the exposure to a second resolved color image (for example, the color image passed through green filter) which occurred at the primary electrostatic image forming position. In such position, the corona discharger 13 moves over the second screen S2 to form on the recording medium P an electrostatic image corresponding to the latent image on the screen S2.

A perfect registration may be established between the visible image on the recording medium P and the electrostatic image by setting the stop position of the synchronizing conveyor belt 12. Thereupon, the corona discharger 13 scans in the same direction as it scanned the first screen S1 (i.e. the discharger has already returned to its initial position), but of course, the corona discharger can also be set as desired so that it scans in the opposite direction (i.e. from the position in which it is ready for movement after scanning).

The second electrostatic image thus formed on the recording medium is again moved by the conveyor belt 13 and at the developing station 14, it is developed into a visible image by a developing unit $14_2$ which imparts a color developer corresponding to a resolved color image (for example, magenta). In this manner, three or four resolved color images are formed in superposed relationship on the recording medium, thus providing a colored copy image. In case of four-color representation, the last or fourth screen S4 is concerned with the image formation corresponding to the inking in ordinary printing, and in the color resolving means 4, primary electrostatic image formation is effected without filter or through an ND filter. By developing an electrostatic image corresponding to such image, a copy image true to the color tone of the original image is produced on the recording medium P. Thereafter, the recording medium P is separated from the conveyor belt 12 by separator means 15 such as separator pawl or the like, and passed to the fixing device 17. The recording medium P heat-fixed by the fixing device 17 is discharged onto a tray 16.

Figure 7:
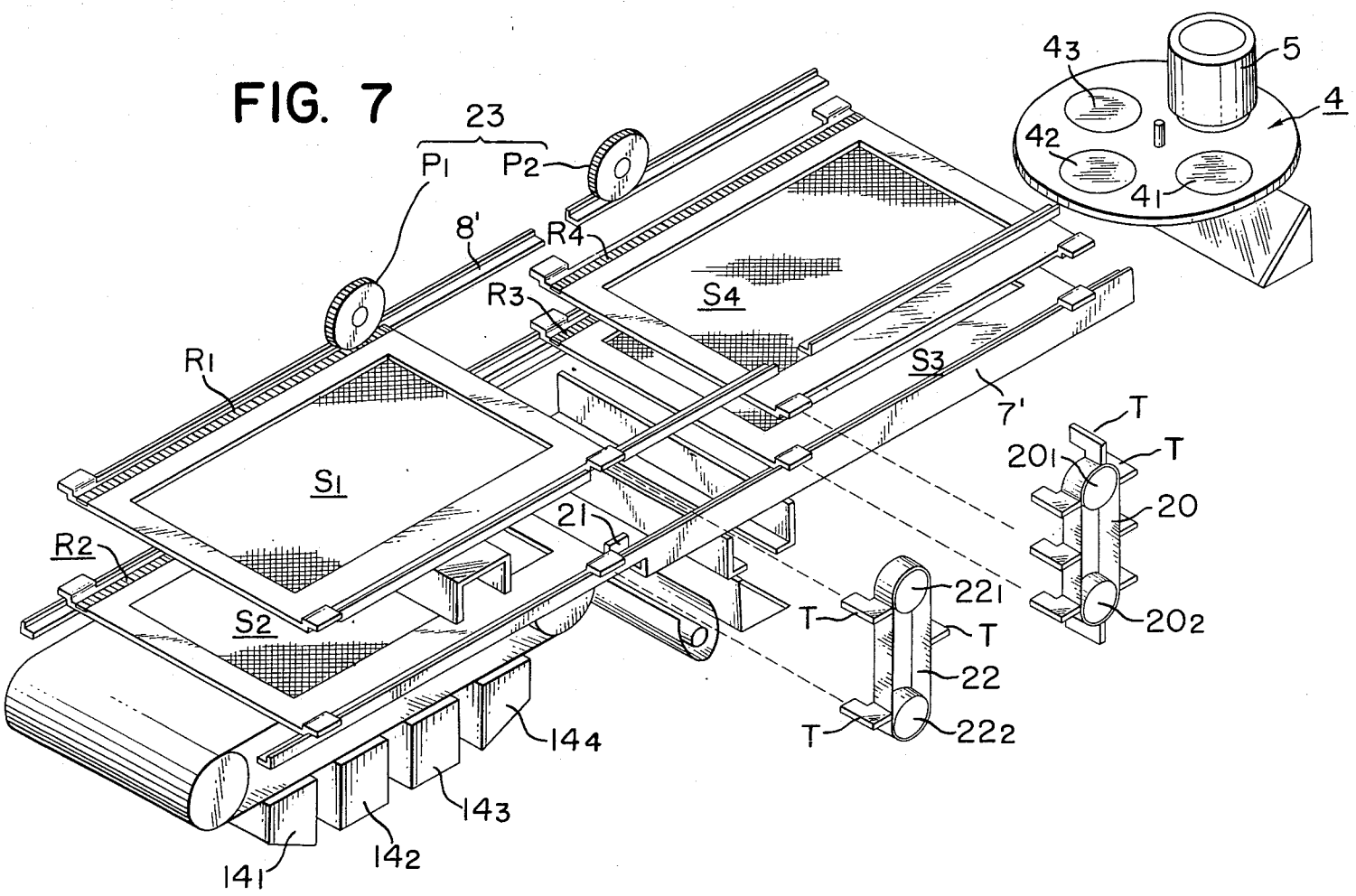
FIG. 7 is a perspective view illustrating the mechanism for moving the photosensitive mediums.

FIG. 7 is a perspective view illustrating an example of the cyclical conveyor mechanism for the screens.

Elevator mechanisms 20-22 for vertically conveying the screens may each comprise equally spaced, endlessly movable support members T, and roller or gears $20_1$ and $20_2$ or $22_1$ and $22_2$ connected by an endless belt or by a chain, as shown in FIG. 8*b*. The support members T may be conveyed at a predetermined interval. In FIG. 8*b*, reference numerals 81 and 82 designate connector pins and coupling plates, respectively.

Conveyor mechanisms 21 and 23 are provided to convey the screens laterally. The conveyor mechanism 21, as shown in FIG. 8*a*, is comprised chiefly of a movable member $21_1$ provided on a lower screen guide 7′ and a conveyor shaft $21_2$. In the shown example, the conveyor shaft $21_2$ is formed with left-hand thread so that, if the conveyor shaft is rotated clockwise as viewed in FIG. 8*a*, the movable member $21_1$ will move leftwardly along the side edge $7'_1$ of the guide 7′. For the return stroke of the movable member 21, the shaft may be rotated in the opposite direction but fortunately at this time, the movable member $21_1$ falls sideways and moves along a portion $7'_2$ without interfering with the subsequent screen.

On the other hand, the screen which has reached an upper screen guide 8′ is moved by mesh engagement between a friction band or rack R provided along a side edge of the frame for the screen and a conveyor drive roller or pinion P.

A plurality of such rollers or pinions P, one at the the end representing the elevated position as designated at P1 and one at the end representing the lowered position as designated at P2, may be provided to ensure perfectly satisfactory conveyance.

It will thus be appreciated that the apparatus of the present invention enables good color representation to be realized without the possibility of color misregistration. Especially, the use of specific photosensitive mediums for the respective specific resolved colors ensure color representation of good balance.

Further, as described, the apparatus of the present invention can assume a configuration suitable for the high-speed mass production of copies, as well as a very compact construction, thus providing important practical advantages.

We claim:

1. A color copying apparatus comprising a plurality of movable, flat photosensitive mediums each having a plurality of openings therein, image exposure means for exposing said photosensitive mediums to color images having color components of an original image, primary electrostatic image forming means cooperable with said image exposure means to form an electrostatic image on each of said photosensitive mediums, support means for movably supporting a charge-retaining member in non-contact relationship with said photosensitive mediums, secondary electrostatic image forming means for forming charge images on said charge-retaining member, said charge images corresponding to the electrostatic images on said photoconductive medium, and developing means having a plurality of developing units disposed adjacent said support means to impart predetermined color developer to develop said charge images.

2. An apparatus according to claim 1, further comprising means for releasably maintaining said plurality of photosensitive mediums in a stacked position, and means for successively moving said mediums (1) out of said position to a primary image forming position wherein a said electrostatic image is formed thereon, (2) to a secondary image forming position wherein a said charge image is formed on said charge retaining member, and (3) back to said stacked position, in a cyclical manner.

3. An apparatus according to claim 2, wherein said support means has an endless conveyor mechanism which moves cyclically in accordance with a predetermined number of colors to be represented, to convey a said charge- retaining member to the developing position after each said formation of a charge image at said secondary image forming position, and, thereafter, to return said member again to said secondary electrostatic image forming position.

4. A color copying apparatus wherein a color image is formed on a recording medium by superposing a predetermined number of resolved color images thereon, said apparatus comprising:

an endless and movable photosensitive medium having numerous openings therein, said photosensitive medium having a photoconductive layer and an insulating layer thereon, and also having a surface thereof which is capable of bearing a predetermined number of resolved color latent images in series in the direction of movement thereof;

means for exposing said photosensitive medium to image light of the resolved color images;

primary electrostatic image forming means for forming electrostatic latent images on said photosensitive medium and including means for applying a primary charge to said photosensitive medium, means for exposing said photosensitive medium to said image light and simultaneously therewith applying a secondary charge thereto with an AC corona discharger or a DC corona discharger of a polarity opposite to that of the primary charge, and means for then exposing the whole surface of the photosensitive medium to light;

developing means having a plurality of developing units for applying predetermined color developers to a charge-retaining member;

means for cyclically moving a charge-retaining member into a face-to-face non-contact relationship with said photosensitive medium and then past said developing means, wherein the number of cycles of said movement corresponds to the number of color resolved images to be recorded;

secondary electrostatic image forming means for forming on the charge-retaining member a separate charge image corresponding to each said electrostatic image formed on said photosensitive medium, wherein said separate charge images are formed during successive cycles of movement of the charge-retaining member into said face-to-face relation with said photosensitive medium; and control means, for actuation when a plurality of copies are to be made from a single original, including means for operating said secondary electrostatic image forming means to re-form separate charge images from a single series of said color resolved electrostatic images formed on said photosensitive medium.

* * * * *

UNITED STATES PATENT AND TRADEMARK OFFICE

CERTIFICATE OF CORRECTION

PATENT NO. : 3,972,608

DATED : August 3, 1976

INVENTOR(S) : INAO MORIYAMA, KEIJI TANAKA, YUJIRO ANDO, and KATSUNOBU OHARA

It is certified that error appears in the above-identified patent and that said Letters Patent are hereby corrected as shown below:

Column 3, line 10, delete "a" and insert --an--.

Column 4, line 6, change "form" to --from--.

line 22, after "the" insert --control circuit for the apparatus of the--.

line 37, delete "an" (first occurrence) and insert --and--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*